US008973243B2

(12) United States Patent
Su

(10) Patent No.: US 8,973,243 B2
(45) Date of Patent: Mar. 10, 2015

(54) MANUFACTURING METHOD OF AN INTEGRALLY FORGED GOLF CLUB HEAD

(71) Applicant: Chi-Hung Su, Tainan (TW)

(72) Inventor: Chi-Hung Su, Tainan (TW)

( * ) Notice: Subject to any disclaimer, the term of this patent is extended or adjusted under 35 U.S.C. 154(b) by 176 days.

(21) Appl. No.: 13/670,049

(22) Filed: Nov. 6, 2012

(65) Prior Publication Data

US 2014/0123471 A1 May 8, 2014

(51) Int. Cl.

| | |
|---|---|
| ***B23Q 3/00*** | (2006.01) |
| ***B23P 17/00*** | (2006.01) |
| ***B21D 22/00*** | (2006.01) |
| ***B23K 31/02*** | (2006.01) |
| ***B21K 17/00*** | (2006.01) |
| *A63B 53/04* | (2006.01) |

(52) U.S. Cl.

CPC ..... *B21K 17/00* (2013.01); *A63B 2053/0491* (2013.01); *A63B 53/0475* (2013.01)

USPC ..... 29/465; 29/527.1; 72/360; 228/228

(58) Field of Classification Search

USPC ..... 29/465, 466, 527.1; 473/324, 334, 335; 72/360; 228/227, 228

See application file for complete search history.

(56) References Cited

U.S. PATENT DOCUMENTS

| | | | | |
|---|---|---|---|---|
| 4,852,880 | A * | 8/1989 | Kobayashi | 473/349 |
| 5,050,879 | A * | 9/1991 | Sun et al. | 473/338 |
| 5,485,998 | A * | 1/1996 | Kobayashi | 473/345 |
| 5,616,088 | A * | 4/1997 | Aizawa et al. | 473/341 |
| 5,766,091 | A * | 6/1998 | Humphrey et al. | 473/324 |
| 5,961,394 | A * | 10/1999 | Minabe | 473/305 |
| 6,045,456 | A * | 4/2000 | Best et al. | 473/291 |
| 6,077,171 | A * | 6/2000 | Yoneyama | 473/291 |
| 6,257,603 | B1 * | 7/2001 | Busch et al. | 280/124.106 |
| 6,729,209 | B1 * | 5/2004 | Chen | 81/63 |
| 6,881,158 | B2 * | 4/2005 | Yang et al. | 473/324 |
| 6,932,875 | B2 * | 8/2005 | Cheng et al. | 148/522 |
| 7,040,000 | B2 * | 5/2006 | Takeda | 29/505 |
| 7,207,899 | B2 * | 4/2007 | Imamoto | 473/332 |
| 7,309,297 | B1 * | 12/2007 | Solari | 473/334 |
| 7,326,472 | B2 * | 2/2008 | Shimazaki et al. | 428/682 |
| 7,744,484 | B1 * | 6/2010 | Chao | 473/324 |
| 7,828,674 | B2 * | 11/2010 | Kubota | 473/335 |
| 7,867,105 | B2 * | 1/2011 | Moon | 473/314 |
| 8,042,253 | B2 * | 10/2011 | Su | 29/525.14 |
| 8,088,023 | B2 * | 1/2012 | Kubota | 473/335 |
| 8,235,843 | B1 * | 8/2012 | Rice et al. | 473/334 |
| 8,337,325 | B2 * | 12/2012 | Boyd et al. | 473/332 |
| 8,434,671 | B1 * | 5/2013 | Su | 228/228 |
| 8,449,405 | B2 * | 5/2013 | Jertson et al. | 473/324 |
| 2002/0019266 | A1 * | 2/2002 | Yabu | 473/345 |
| 2003/0015015 | A1 * | 1/2003 | Takeda | 72/340 |
| 2004/0043830 | A1 * | 3/2004 | Imamoto | 473/332 |
| 2005/0197208 | A1 * | 9/2005 | Imamoto | 473/349 |

(Continued)

*Primary Examiner* — Essama Omgba

(74) *Attorney, Agent, or Firm* — Muncy, Geissler, Olds & Lowe, P.C.

(57) ABSTRACT

A manufacturing method of an integrally forged golf club head has acts of: forging a crude rod to form a blank of a main body of a golf club head, mounting a weight in a mounting recess of the blank of the main body of the golf club head, covering the mounting recess with an outer cover, and then welding and forging the blank of the main body of the golf club head and the outer cover to form a golf club head. Thus, the at least one weight is securely held in the golf club head and does not come off the golf club head, and also no noise occurs when the golf club head strikes a golf ball. Furthermore, the at least one weight is not exposed so that the golf club head has a good appearance and improved quality.

5 Claims, 2 Drawing Sheets

(56) References Cited

U.S. PATENT DOCUMENTS

| | | | | |
|---|---|---|---|---|
| 2008/0085782 | A1* | 4/2008 | Kubota | 473/350 |
| 2008/0194374 | A1* | 8/2008 | Diosi et al. | 475/275 |
| 2009/0298615 | A1* | 12/2009 | Moon | 473/350 |
| 2011/0021290 | A1* | 1/2011 | Kubota | 473/350 |
| 2012/0186060 | A1* | 7/2012 | Su | 29/407.05 |
| 2013/0137532 | A1* | 5/2013 | Deshmukh et al. | 473/349 |
| 2013/0281229 | A1* | 10/2013 | Su | 473/349 |
| 2013/0288823 | A1* | 10/2013 | Hebreo | 473/349 |
| 2013/0305801 | A1* | 11/2013 | Liang et al. | 72/340 |
| 2014/0073450 | A1* | 3/2014 | Hebreo et al. | 473/342 |

* cited by examiner

MANUFACTURING METHOD OF AN INTEGRALLY FORGED GOLF CLUB HEAD

BACKGROUND OF THE INVENTION

1. Field of the Invention

The present invention relates to a manufacturing method of a golf club head, especially to a manufacturing method of an integrally forged golf club head of an iron-type golf club.

2. Description of the Prior Art(s)

To improve striking performances of iron golf clubs, an iron golf club head has a main body and a weight mounted in the main body. The weight and the main body are made of different materials. The weight has higher or lower specific gravity compared to the main body so that the iron golf club head has better weight distribution. For instance, to improve the more forgiveness of the iron golf club head, the weight with the higher specific gravity compared to the main body is mounted in a bottom of a back of the main body of the golf club head.

Many conventional ways are adopted to achieve mounting the weight in the main body of the iron golf club head. One of the conventional ways is to screw the weight on the back of the main body. Another one of the conventional ways is to adhere the weight to the back of the main body with glues such as an epoxy adhesive. Another one of the conventional ways is to weld the weight to the back of the main body.

However, since the weight on the back of the main body is exposed outside of the main body, screwing and adhering the weight to the main body is hard to securely attach the weight to the main body. Moreover, although the weight is more securely attached to the main body by welding than by screwing and adhering, the weight and the main body are hard to be completely welded together since they are different metals. Thus, a connection between the weight and the main body are still unstable. After the golf club head has been used for a period of time, the weight may come off the main body easily or noises easily occur when the golf club head strikes a golf ball.

Furthermore, screwing, adhering or welding the weight to the main body also exposes the weight out of the main body of the golf club head so that the golf club head has a non-integrated appearance. Consequently, a quality of the golf club head cannot be improved.

To overcome the shortcomings, the present invention provides a manufacturing method of an integrally forged golf club head to mitigate or obviate the aforementioned problems.

SUMMARY OF THE INVENTION

The main objective of the present invention is to provide a manufacturing method of an integrally forged golf club head. The manufacturing method has acts of forging a crude rod to form a blank of a main body of a golf club head, mounting at least one weight in at least one mounting recess of the blank of the main body of the golf club head, covering the at least one mounting recess with at least one outer cover that is made of the same material as the blank of the main body of the golf club head, and then welding and forging the blank of the main body of the golf club head and the at least one outer cover to form a golf club head.

Thus, the at least one weight is securely held in the golf club head and does not come off the golf club head, and no noise occurs when the golf club head strikes a golf ball. Furthermore, the at least one weight is not exposed so that the golf club head has a good appearance and improved quality.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
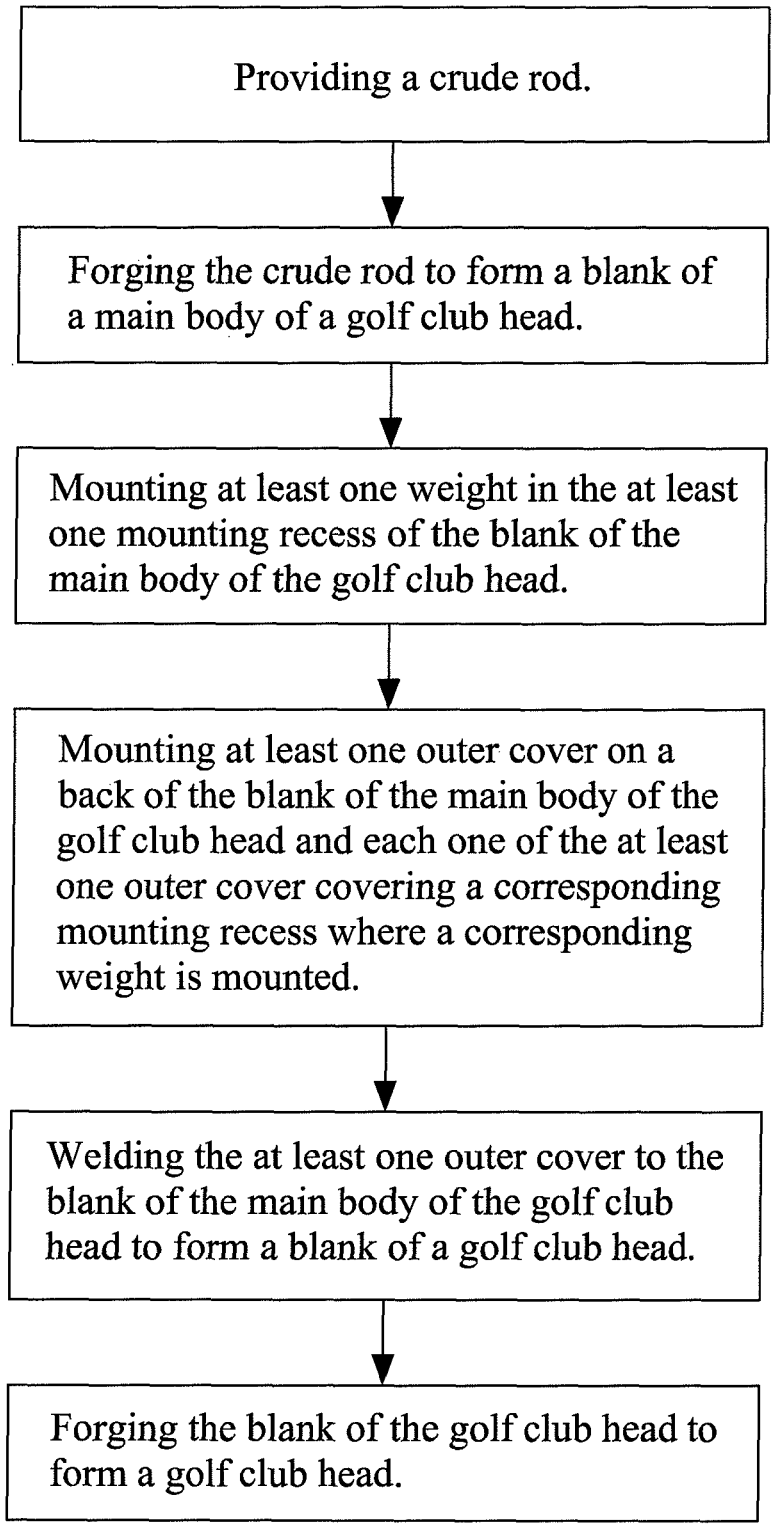
FIG. 1 is a flow chart of a manufacturing method of an integrally forged golf club head in accordance with the present invention.

With reference to FIG. 1, a manufacturing method of an integrally forged golf club head in accordance with the present invention comprises the following acts.

Figure 2A:
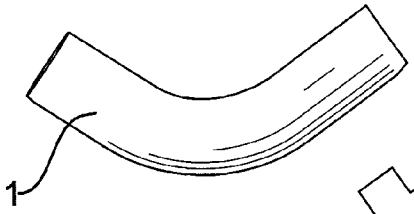
FIG. 2A is an operational perspective view of the golf club head manufactured by the method in FIG. 1, showing a crude rod is provided.

With further reference to FIG. 2A, a crude rod 1 is provided. The crude rod 1 has a predetermined radius and length based on the predetermined size of the golf club head. The crude rod 1 is made of metal such as carbon steel, stainless steel or the like.

Figure 2B:
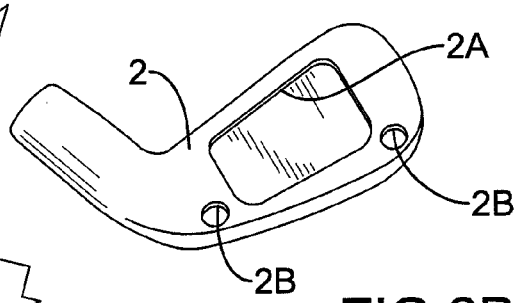
FIG. 2B is an operational perspective view of the golf club head manufactured by the method in FIG. 1, showing the crude rod is forged to form a blank of a main body of a golf club head.

With further reference to FIG. 2B, the crude rod 1 is forged to form a blank 2 of a main body of a golf club head. The crude rod 1 is pressed with molds to form the blank 2 of the main body of the golf club head having a predetermined shape. The blank 2 of the main body of the golf club head has a back and at least one mounting recess 2A, 2B. The at least one mounting recess 2A, 2B is formed on the back of the blank 2 of the main body of the golf club head. A position, a size and a shape of each one of the at least one mounting recess 2A, 2B are arranged or formed according to the characteristic of the golf club head and a material of a weight for the golf club head, etc.

Figure 2C:
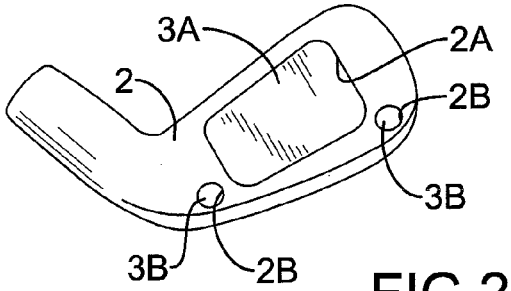
FIG. 2C is an operational perspective view of the golf club head manufactured by the method in FIG. 1, showing at least one weight is mounted in at least one mounting recess of the blank of the main body of the golf club head.

With further reference to FIG. 2C, at least one weight 3A, 3B is pre-formed and is mounted in the at least one mounting recess 2A, 2B of the blank 2 of the main body of the golf club head. Each weight 3A, 3B is mounted in a corresponding mounting recess 2A, 2B of the blank 2 of the main body of the golf club head. Each weight 3A, 3B is made by a certain material that is chosen according to the characteristic of the golf club head and a position of each weight 3A, 3B.

The golf club head in accordance with the present invention may have multiple weights 3A, 3B mounted in the back of the blank 2 of the main body of the golf club head. The weights 3A, 3B may be made of a single material or different materials. Optionally, some of the weights 3A may be made of one same material while the other weights 3A, 3B are made of different materials.

Each weight 3A, 3B may be made of at least one alloy material having a specific gravity that is higher or lower than a specific gravity of the material of the blank 2 of the main body of the golf club head. Optionally, each weight may be made of a mixing alloy material, which is mixed by one alloy material with a specific gravity that is higher than the specific gravity of the material of the blank 2 of the main body of the golf club head and another alloy material with a specific gravity that is lower than the specific gravity of the material of the blank 2 of the main body of the golf club head.

In the preferred embodiment, the blank 2 of the main body of the golf club head is made of carbon steel having the specific gravity of about 7.863 g/c.c., stainless steel having the specific gravity of about 7.85 g/c.c. or the like. The alloy material with the higher specific gravity may be tungsten steel having the specific gravity of about 10~18 g/c.c., copper alloy having the specific gravity of about 8.0~8.9 g/c.c. or the like. The alloy material with the lower specific gravity may be titanium alloy having the specific gravity of about 4.2~4.8 g/c.c., an aluminum alloy having the specific gravity of about 2.5~2.8 g/c.c. or the like.

For instance, when the at least one weight 3A, 3B is mounted in a center of the back of the blank 2 of the main body of the golf club head, the at least one weight 3A, 3B is preferably made of the alloy material having the lower specific weight. When the at least one weight 3A, 3B is mounted in a bottom of the back of the blank 2 of the main body of the golf club head, the at least one weight 3A, 3B is preferably made of the alloy material having the higher specific weight.

Figure 2D:
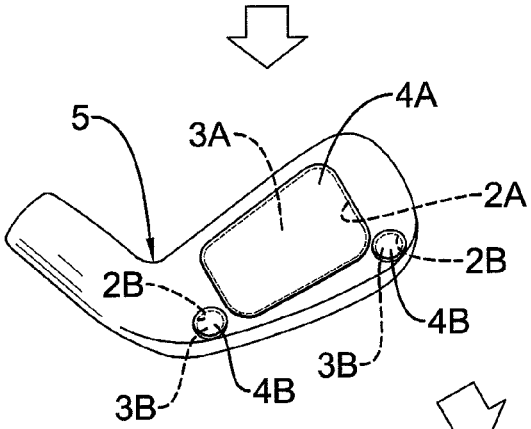
FIG. 2D is an operational perspective view of the golf club head manufactured by the method in FIG. 1, showing at least one outer cover is mounted on and is welded to the blank of the main body of the golf club head to form a blank of a golf club head.

With further reference to FIG. 2D, at least one outer cover 4A, 4B is mounted on the back of the blank 2 of the main body of the golf club head. Each cover 4A, 4B covers a corresponding mounting recess 2A, 2B where a corresponding weight 3A, 3B is mounted. The cover 4A, 4B is made of the same material as the blank 2 of the main body of the golf club head. Preferably, each cover 4A, 4B has an area larger than an area of an opening of the corresponding mounting recess 2A, 2B so that the cover 4A, 4B completely covers the corresponding mounting recess 2A, 2B.

The at least one outer cover 4A, 4B is welded to the blank 2 of the main body of the golf club head to form a blank 5 of a golf club head. The at least one outer cover 4A, 4B is welded onto the back of the blank 2 of the main body of the golf club head with welding means, such as laser welding, to form the blank 5 of the golf club head.

Figure 2E:
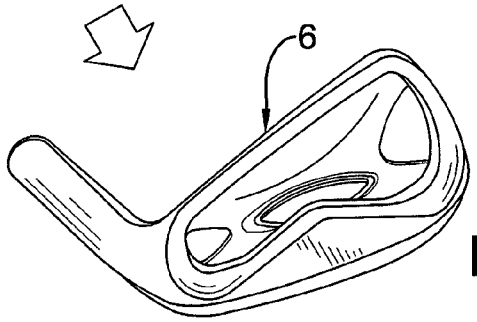
FIG. 2E is an operational perspective view of the golf club head manufactured by the method in FIG. 1, showing the blank of the golf club head is forged to form a golf club head.

With further reference to FIG. 2E, the blank 5 of the golf club head is forged to form a golf club head 6. The blank 5 of the golf club head is pressed with molds to form the golf club head 6 having a predetermined shape. Thus, the at least one outer cover 4A, 4B and the blank 2 of the main body of the golf club head 2 that are made of the same material are press-forged to one piece. Consequently, the at least one weight 3A, 3B is securely held in the golf club head 6.

The crude rod 1 may be bent by a bending machine in advance.

In the step of forging the crude rod 1 to form the blank 2 of the main body of the golf club head, the crude rod 1 may be forged through a single forging process or through multiple forging processes to press the crude rod 1 to the blank 2 of the main body of the golf club head with the molds. Moreover, the forging processes may comprise a rough forging process and a fine forging process to forge the blank 2 of the main body of the golf club head in sequence.

The manufacturing method of the integrally forged golf club head as described has the following advantages. The at least one weight 3A, 3B is mounted in the at least one mounting recess 2A, 2B of the blank 2 of the main body of the golf club head, and the at least one outer cover 4A, 4B that is made of the same material as the blank 2 of the main body of the golf club head covers and is welded on the at least one mounting recess 2A, 2B. Then the at least one outer cover 4A, 4B and the blank 2 of the main body of the golf club head are forged to form the golf club head 6. Thus, the at least one weight 3A, 3B is securely held in the golf club head 6 and does not come off the golf club head 6, and also no noise occurs when the golf club head 6 strikes a golf ball. Furthermore, since the golf club head 6 is formed by welding and forging the at least one outer cover 4A, 4B to the blank 2 of the main body of the golf club head to prevent the at least one weight 3A, 3B from being exposed, the golf club head 6 has a good appearance as the shape of the golf club head 6 is the same as it is intended to be formed, and has improved quality.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A manufacturing method of an integrally forged golf club head comprising acts of:

providing a crude rod;

forging the crude rod to form a blank of a main body of a golf club head, wherein the crude rod is pressed with molds to form the blank of the main body of the golf club head; and the blank of the main body of the golf club head has at least one mounting recess formed on a back of the blank of the main body of the golf club head;

mounting at least one weight in the at least one mounting recess of the blank of the main body of the golf club head;

mounting at least one outer cover on the back of the blank of the main body of the golf club head and each one of the at least one outer cover covering a corresponding mounting recess where a corresponding weight is mounted, wherein the at least one outer cover and the blank of the main body of the golf club head are made of the same material;

welding the at least one outer cover to the blank of the main body of the golf club head to form a blank of a golf club head; and forging the blank of the golf club head to form a golf club head, wherein the blank of the golf club head is pressed with molds to form the golf club head;

the at least one outer cover and the blank of the main body of the golf club head that are made of the same material are press-forged to one piece; and the at least one weight is securely held in the golf club head.

2. The manufacturing method as claimed in claim 1, wherein the crude rod is bent by a bending machine in advance before forging to form the blank of the main body of the golf club head.

3. The manufacturing method as claimed in claim 2, wherein in the step of forging the crude rod, the crude rod is forged through a single forging process to form the blank of the main body of the golf club head.

4. The manufacturing method as claimed in claim 2, wherein in the step of forging the crude rod to form the blank of the main body of the golf club head, the crude rod is forged through multiple forging processes to press the crude rod to the blank of the main body of the golf club head.

5. The manufacturing method as claimed in claim 4, wherein the forging processes comprise a rough forging process and a fine forging process to forge the blank of the main body of the golf club head in sequence.

* * * * *